US005234131A

United States Patent [19]

Griffin

[11] Patent Number: 5,234,131

[45] Date of Patent: Aug. 10, 1993

[54] APPARATUS FOR PREVENTING EXCESSIVE FREEZING OF THE ICE BANK IN BEVERAGES DISPENSERS

[75] Inventor: Weldon E. Griffin, San Antonio, Tex.

[73] Assignee: Lancer Corporation, San Antonio, Tex.

[21] Appl. No.: 832,361

[22] Filed: Feb. 7, 1992

[51] Int. Cl.[5] ..... B67D 5/62

[52] U.S. Cl. ..... 222/146.6; 62/59

[58] Field of Search ..... 222/129.1, 146.6; 62/59, 394, 395

[56] References Cited

U.S. PATENT DOCUMENTS

| | | | |
|---|---|---|---|
| 3,892,335 | 7/1975 | Schroeder | 222/129.1 |
| 4,008,832 | 2/1977 | Rodth | 222/129.1 |
| 4,011,733 | 3/1977 | Kückens et al. | 62/59 |
| 4,124,994 | 11/1978 | Cornelius et al. | 62/59 X |
| 4,497,179 | 2/1985 | Iwans | 62/59 |
| 4,545,505 | 10/1985 | Mueller et al. | 222/146.6 X |
| 4,615,466 | 10/1986 | Credle, Jr. | 222/129.1 |
| 4,801,048 | 1/1989 | Credle, Jr. et al. | 222/129.1 |
| 4,916,910 | 4/1990 | Schroeder | 62/59 |
| 4,934,150 | 6/1990 | Fessler | 62/59 |
| 5,035,121 | 7/1991 | Cook | 222/146.6 X |

*Primary Examiner*—Andres Kashnikow
*Assistant Examiner*—Kenneth Bomberg
*Attorney, Agent, or Firm*—Donald R. Comuzzi

[57] ABSTRACT

The present invention is a drink dispenser of the evaporator coil electric refrigeration system type which provides for an increased drink dispensing capacity. The present invention is provided with insulator pads affixed to the evaporator coils to prevent the ice bank from forming against a portion of the tank walls, and to provide a channel between the lower and upper portions of the tank to create an increased circulation of cooling liquid about the ice bank. That increased circulation increases the amount of heat that can be exchanged between the product lines and the cooling liquid, thereby increasing the amount of drinks that may be dispensed below a temperature of 40° F.

5 Claims, 2 Drawing Sheets

APPARATUS FOR PREVENTING EXCESSIVE FREEZING OF THE ICE BANK IN BEVERAGES DISPENSERS

BACKGROUND OF THE INVENTION

The present invention relates to a device for dispensing beverages, and more particularly, but not by way of limitation, to improvements on such a device for increasing its drink serving capacity while maintaining or reducing the space occupied and insuring that the beverages dispensed are adequately cooled.

In typical locations where beverages are dispensed, such as in cafeterias and snack bars, the value of counterspace is at a premium. Counterspace in a food serving line is very expensive, especially in larger metropolitan areas. For that reason, beverage dispensing machines are desirably small and compact.

Additionally, it is critical for beverage dispensers to adequately cool dispensed beverages despite frequent use of the dispenser over extended periods of time. One of the most successful methods for accomplishing this objective is to provide a machine which, during periods of non-use, forms an ice bank which slowly melts while cooling the beverages during periods of frequent use. To provide a heat pumping unit which could adequately cool beverages without such an ice bank would put unfeasible power requirements on the unit; the necessary unit would be expensive and oversized.

Typical beverage dispensers employ evaporator coils as part of an electric refrigeration system which forms an ice bank from water placed in a tank. The beverage lines in such a unit are also submerged within the tank to enable cooling of the beverages before dispensing. The water is cooled by ice forming on the evaporator coils, and the cooled water is circulated about the beverage lines by an impeller or other circulating means to cool the beverages to a desired temperature.

The ability of such beverage dispensers to adequately cool during extended period of frequent use depends significantly upon the size and orientation of the ice bank relative to the beverage lines. In fact, since larger ice banks ordinarily take longer amounts of time to melt, the volume of the ice bank formed in such a dispenser is a primary consideration for rating the dispenser. Those factors combined with the degree of insulation provided, the effectiveness of the cooling unit, and the manner of circulation within the cooling tank usually determine the dispenser's ability to adequately operate. To optimize each of those factors while minimizing space is the primary challenge in the technology of beverage dispensers.

Beverage dispensers of this type are also rated by the number of drinks that can be dispensed below a given temperature during a given period of time, and by the temperature of the "occasional drink" (i.e., the temperature of a drink dispensed after the dispenser has not been used for a period of several hours). In the beverage dispensing market, it is desirable that the beverages be dispensed at a temperature of 40° F. or below. A test generally used to determine the maximum capacity of a beverage dispensing apparatus is one determining the total number of twelve ounce beverages that a machine can dispense in a given period of time without exceeding the maximum temperature of 40° F. The occasional drink, which may contain some beverages from lines between the cooling tank and the nozzle, should be maintained below the desired temperature as well.

An example of the above type beverage dispenser is disclosed in the assignee's U.S. Pat. No. 3,892,335, entitled "BEVERAGE DISPENSER" which issued Jul. 1, 1975, and is herein incorporated by reference. That beverage dispenser comprises a tank in which the product lines are positioned in the center and circumferentially surrounded by the evaporator coils. A cooling unit, having a motor driven propeller which extends into the center of the product lines, resides above the evaporator coils. The tank is filled with water to provide the cooling liquid. In operation, an ice bank forms about the evaporator coils, with the water about the product lines remaining liquid. The motor driven propeller rotates to circulate the liquid water about the product lines to produce product cooling.

However, during periods of low use, the ice bank will form such that it abuts both the product lines and the inner walls of the tank. When that occurs, the surface area of the ice bank in contact with the liquid water is reduced, thereby reducing the amount of heat capable of being exchanged between the two. Accordingly, during a subsequent period of peak use, the liquid water is unable to efficiently transfer the heat from the product to the ice bank. As a result, the beverage dispenser produces a limited number of drinks dispensed at a temperature below 40° F. Once the temperature of the dispensed beverage rises above 40° F., the carbon dioxide in solution with the product becomes a gas, which causes the dispensed drink to foam. After the drinks begin to foam, the dispensing capacity of the beverage dispenser has been exceeded.

A second beverage dispenser which provides an improvement over the above dispenser is disclosed in the assignee's U.S. Pat. No. 4,916,910, entitled "LOW PROFILE DRINK DISPENSER" which issued Apr. 16, 1990, and is herein incorporated by reference. That beverage dispenser positions the product lines in the bottom of a tank with the evaporator coils residing above the product lines to form an ice bank. A motor driven impeller is also provided above the product lines to circulate the liquid water. The "LOW PROFILE DRINK DISPENSER" operates similarly to the above beverage dispenser, and therefore, experiences the same problem. That is, during periods of infrequent use, the ice bank forms such that it abuts the inner walls of the tank. Once again, the surface area of the liquid water in contact with the ice bank is diminished. Thus, during subsequent peak use times, the inefficient heat exchange between the product, water and ice bank limits the amount of drinks which may be dispensed at a temperature below 40° F.

Therefore, the present invention has been set forth to provide a beverage dispensing apparatus that alleviates the above problem encountered in the prior art by providing a means for increasing the surface area of the water in contact with the ice bank, thereby increasing the drink serving capacity of the present invention while maintaining the small and compact dispenser size necessary for use in a limited counterspace area.

SUMMARY OF THE INVENTION

The present invention comprises a cooling unit, having a motor driven impeller or propeller, attached to evaporator coils which reside in a tank portion. Also residing in the tank portion are product lines and water lines which communicate product and water to a set of dispensing valves. To overcome the problem of the ice bank forming such that it extends completely to the inner walls of the tank portion, the present invention is provided with insulator pads affixed to the back corners of the evaporator coils. The insulator pads prevent the ice bank from forming against the back corners of the inner walls of the tank portion. Additionally, because the insulator pads prevent the ice bank from forming in the tank portion's back corners, two liquid water filled channels are created therebetween.

Those channels are created to increase the surface area of the cooling liquid contacting the ice bank as the cooling liquid circulates in the tank portion. Both water circulation and cooling liquid contact with the ice bank are increased because the rotating impeller forces the cooling liquid through the cavities and back onto the ice bank. That increased circulation and exposed surface area provides increased heat exchange between the product and the ice bank via the cooling liquid, thereby allowing more product to be dispensed at a temperature below 40° F. The improved heat exchange increases the drink dispensing capacity of the present invention. Thus, the insulator pads serve not only to limit the ice bank size but also to increase the surface area of the ice bank exposed to the circulating cooling liquid.

Therefore, it is a primary object of the present invention to provide a drink dispenser with an increased drink serving capacity.

Many other objects, features, advantages, and modifications within the scope of this invention will be obvious to one of ordinary skill in the art in light of the foregoing and the following.

DETAILED DESCRIPTION OF THE PREFERRED EMBODIMENT

Figure 1:
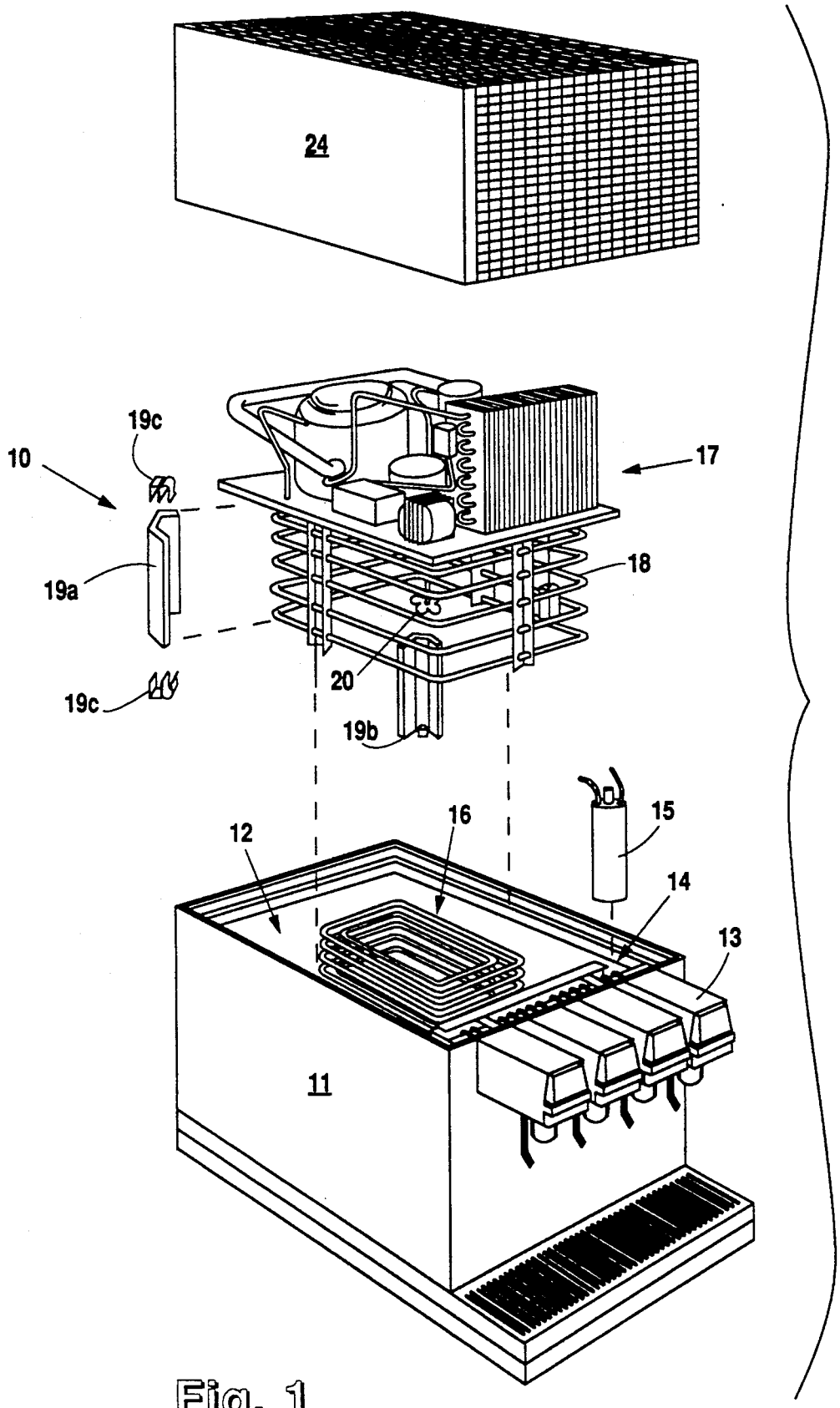
FIG. 1 shows an exploded perspective view of the preferred embodiment of the present invention.

Referring to FIG. 1, the beverage dispenser of the preferred embodiment of the present invention will be described. Beverage dispenser 10 comprises housing 11 having tank portion 12 and dispensing valves 13. Beverage dispenser 10 further comprises product lines 14 and carbonator tank 15 positioned in the front of tank portion 12. Water lines 16 reside in tank portion 12 positioned about the center of tank portion 12. Water lines 16 are in communication with a water source (not shown) to provide chilled water to carbonator tank 15. Carbonator tank 15 is in communication with a carbon dioxide source (not shown), and functions to deliver carbonated water to dispensing valves 13. Product lines 14 are in communication with a product source (not shown) to deliver the product to dispensing valves 13.

Beverage dispenser 10 further comprises cooling unit 17 which resides above evaporator coils 18. Cooling unit 17 is provided with motor driven impeller 20 which extends down between evaporator coils 18. Evaporator coils 18 reside inside tank portion 12 and circumferentially surround water lines 16. Additionally, insulator pads 19A and B are affixed to the back corners of evaporator coils 18 before evaporator coils 18 are placed in tank portion 12. In the preferred embodiment, insulator pads 19A and B are constructed of foam and affixed to evaporator coils 18 using clips 19C. However, one of ordinary skill in the art will readily recognize that any conventional material such as plastic and any conventional attachment means such as a nut and bolt could be substituted. A decorative cover (not shown) is placed over cooling unit 17 so that it will be attractive when setting on a serving counter.

Figure 2:
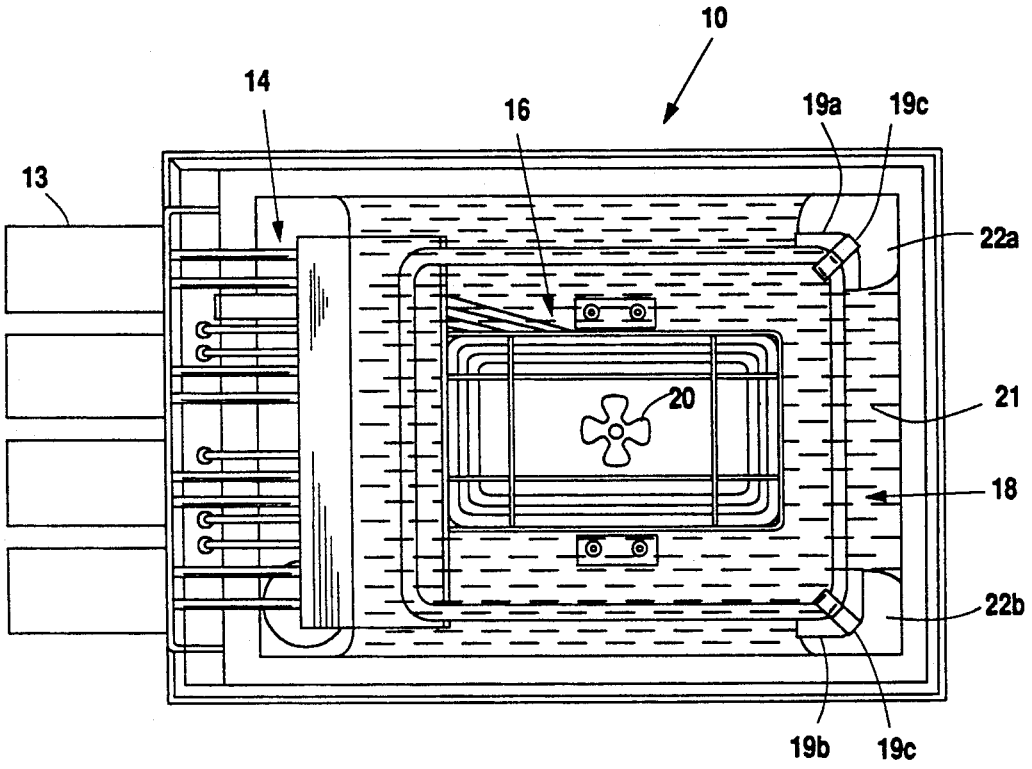
FIG. 2 shows a cut-a-way top view of the preferred embodiment of the present invention.

Referring to FIG. 2, the operation of the beverage dispenser of the preferred embodiment of the present invention will be described. Tank portion 12 is filled with a cooling liquid, water in the preferred embodiment, and cooling unit 17 is engaged to form ice bank 21. Ice bank 21 may form inside of evaporator coils 18 until it abuts water lines 16. Ice bank 21 further may form outside evaporator coils 18 until it abuts the inner walls of tank portion 12. However, unlike prior art beverage dispensers, insulator pads 19A and B prevent ice bank 21 from forming to fill the back corners of tank portion 12, thereby leaving water filled channels 22A and B. The cooling liquid circulating about product lines 14, water lines 16 and through channels 22A and B provide the medium for heat exchange between the product, water and ice bank. That exchange of heat allows the dispensed final product to served at a temperature below 40° F.

Conventional beverage dispensers without insulator pads 19A and B form ice banks which extend into the rear corners of the tank portion. Thus, during periods of frequent use, although there is a large ice bank, there is a small surface area for heat exchange between the cooling water and the ice bank. That arrangement makes the heat exchange between the product and water lines and the cooling liquid and ice extremely inefficient, thereby limiting the drink dispensing capacity of the conventional beverage dispenser.

The present invention overcomes that problem by the use of insulator pads 19A and B which prevent ice bank 21 from forming into the back corners of tank portion 12. Thus, as impeller 20 circulates the cooling water about product lines 14 and water lines 16, it also circulates the cooling water through channels 22A and B such that the cooling water flows across ice bank 21 and back towards water lines 16, thereby increasing the surface area of ice bank 21 exposed to the cooling water. The added amount of cooling water exposed to ice bank 21 through channels 22A and B increases the heat exchange between them. As a result, the amount of heat that is removed from the product by the cooling water also increases. Thus, the dispensing capacity of beverage dispenser 10 of the preferred embodiment of the present invention is increased. Additionally, the occasional drink will be served at a lower temperature.

Further, although the present invention has been described in terms of the foregoing preferred embodiment, as would be obvious to one of ordinary skill in the art, many other reconfigurations, alternations and substitutions are also enabled by this disclosure, and it is therefore intended that the scope of the invention not be limited by the foregoing, but rather encompass such and be defined by the following claims.

We claim:

1. An apparatus for preventing excessive ice buildup in a beverage dispenser containing liquid conduit lines, comprising:

a fluid-filled receptacle defining a cooling chamber;

means forming a slab of frozen material from said fluid inside said cooling chamber; and means creating at least one fluid-filled channel between said slab of frozen material and said cooling chamber, wherein said fluid-filled channel allows fluid to circulate from underneath said means creating said at least one fluid-filled channel, through said fluid-filled channel, and over the top of said means creating said at least one fluid filled channel, thereby allowing fluid circulation about said slab of frozen material.

2. The apparatus according to claim 1 further comprising a means to circulate unfrozen fluid through said channel and about said slab and said liquid conduit lines to enable the transfer of heat.

3. The apparatus according to claim 2 wherein said means forming said slab of frozen material comprises evaporator coils disposed in said cooling chamber for freezing said fluid around said evaporator coils.

4. The apparatus according to claim 3 wherein said means creating at least one fluid-filled channel comprises at least one insulator pad affixed to said evaporator coils.

5. The apparatus according to claim 1 wherein said circulation means comprises an impeller.

* * * * *